US009445181B1

(12) United States Patent
Atwater

(10) Patent No.: US 9,445,181 B1
(45) Date of Patent: Sep. 13, 2016

(54) INTEGRATED HEADPHONE INSERT DEVICE

(71) Applicant: Chadwick Atwater, Whiitier, CA (US)

(72) Inventor: Chadwick Atwater, Whiitier, CA (US)

( * ) Notice: Subject to any disclaimer, the term of this patent is extended or adjusted under 35 U.S.C. 154(b) by 0 days.

(21) Appl. No.: 14/833,408

(22) Filed: Aug. 24, 2015

(51) Int. Cl.
*H04R 25/00* (2006.01)
*H04R 1/10* (2006.01)

(52) U.S. Cl.
CPC ..... *H04R 1/105* (2013.01); *H04R 1/1033* (2013.01); *H04R 1/1066* (2013.01)

(58) Field of Classification Search
CPC ..... H04R 2201/023; H04R 5/0335; H04R 1/1033; H04R 5/023; H04R 1/10; H04R 1/105; H04R 1/1066; A42B 1/245; A41D 1/002
USPC ..... 381/374, 376, 385–386, 392, 87; 2/209
See application file for complete search history.

(56) References Cited

U.S. PATENT DOCUMENTS 4,648,130 A 3/1987 Kuznetz
4,864,619 A * 9/1989 Spates ..... H04R 5/0335 381/309
5,329,591 A 7/1994 Magrill
5,881,390 A 3/1999 Young
6,305,026 B1 10/2001 Mo
D501,979 S 2/2005 Lundgren
7,974,432 B1 7/2011 Ryan
8,009,847 B2 8/2011 Planansky
8,144,913 B1 * 3/2012 Myles, Jr. ..... A47C 7/383 381/333
8,189,844 B2 5/2012 Dolberg
8,650,666 B2 2/2014 Crutcher
9,055,795 B2 * 6/2015 Larkin ..... A45C 11/00
2006/0185062 A1 * 8/2006 Peng ..... H04R 5/0335 2/209.13
2011/0116673 A1 5/2011 Lewis

FOREIGN PATENT DOCUMENTS

WO WO2008098437 8/2008

* cited by examiner

*Primary Examiner* — Davetta W Goins
*Assistant Examiner* — Phylesha Dabney

(57) ABSTRACT

An integrated headphone insert device for listening to audio output while wearing a cap includes a curved band. The band is flexible and curved. Each of a back tab, a left tab, and a right tab are coupled to and extend from the band. A headphone set includes a main cable being split having a right cable extending through the right tab and a left cable extending through the left tab. Left and right earbuds are coupled to the left and right cables respectively.

8 Claims, 4 Drawing Sheets

INTEGRATED HEADPHONE INSERT DEVICE

BACKGROUND OF THE DISCLOSURE

Field of the Disclosure

The disclosure relates to headphone insert devices and more particularly pertains to a new integrated headphone insert device for listening to audio output while wearing a cap or hat.

SUMMARY OF THE DISCLOSURE

An embodiment of the disclosure meets the needs presented above by generally comprising a curved band that is flexible. The curved band has an interior surface, an exterior surface, a top edge, a bottom edge, a left front edge and a right front edge that extend between the top edge and the bottom edge, and a solid internal body defined by the top edge, the bottom edge, the left front edge and the right front edge, the interior surface and the exterior surface. The device comprises a left tab, a right tab and a back tab that are flexible. The left tab is coupled to the top edge proximate to the left front edge and extends from the top edge adjacent and parallel to the interior surface, a right tab. The right tab is coupled to the top edge proximate to the right front edge and extends from the top edge adjacent and parallel to the interior surface. The back tab is coupled to the top edge equally distant to the left tab and the right tab and extends from the top edge adjacent and parallel to the interior surface. The device also comprises an integrated headphone set. The headphone set comprises a main cable that has a first end and a split end. An input plug is coupled to the first end of the main cable. The split end is embedded in the back tab. The split end forms a left cable and a right cable. The left cable is embedded in the solid internal body from the left intersection of the back tab and the top edge to the proximate junction of the left tab and top edge. The left cable is embedded in the left tab until exiting out the bottom of the left tab. The left cable has a terminus coupled to a left ear bud. The right cable is embedded in the solid internal body from the right intersection of the back tab and the top edge to the proximate convergence of the right tab and the top edge. The right cable is embedded in the right tab until exiting out the foot of the right tab. The right cable has an end coupled to a right ear bud.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
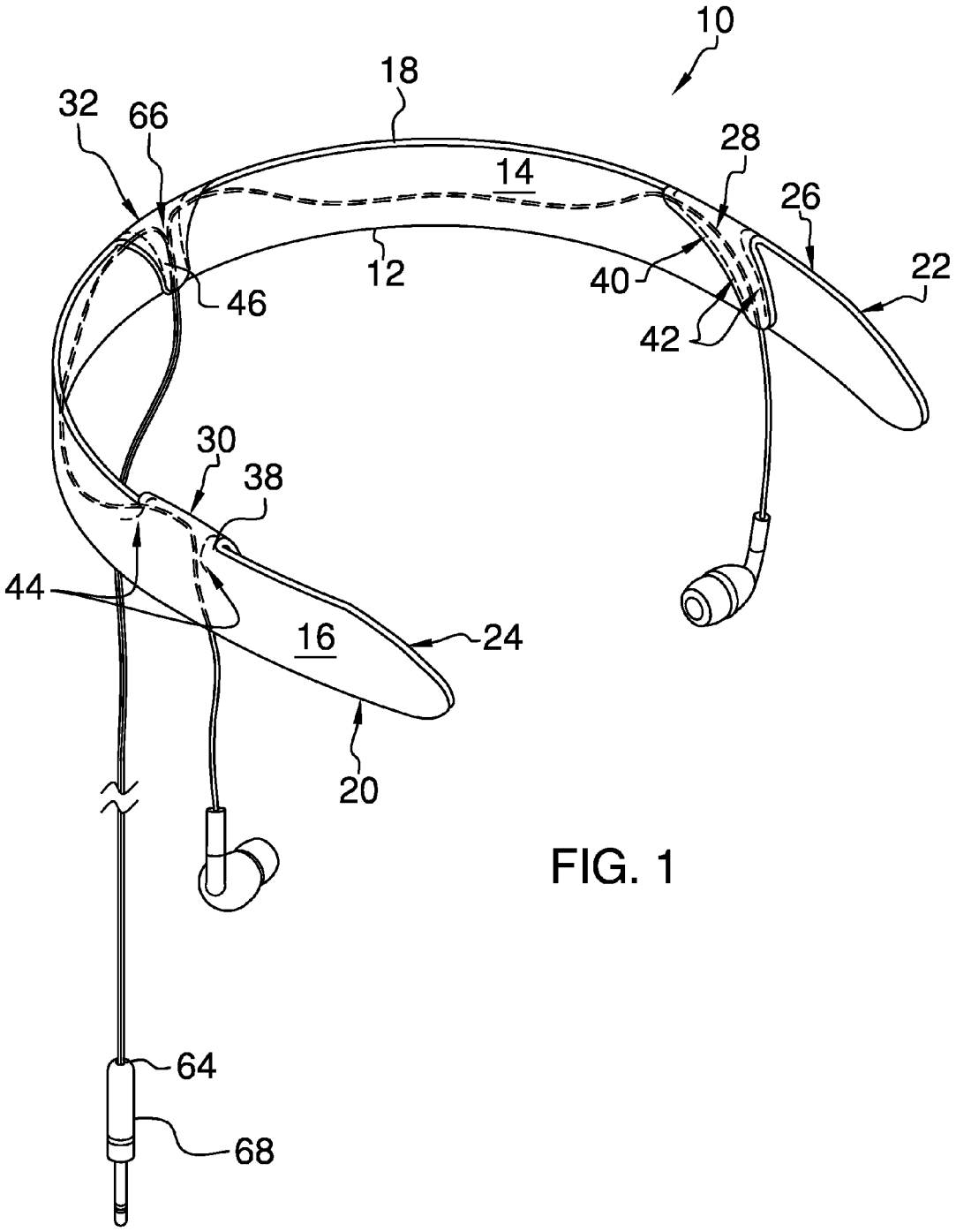
FIG. 1 is a perspective top view of a integrated headphone insert device for listening to audio output while wearing a cap or hat according to an embodiment of the disclosure.
Figure 2:
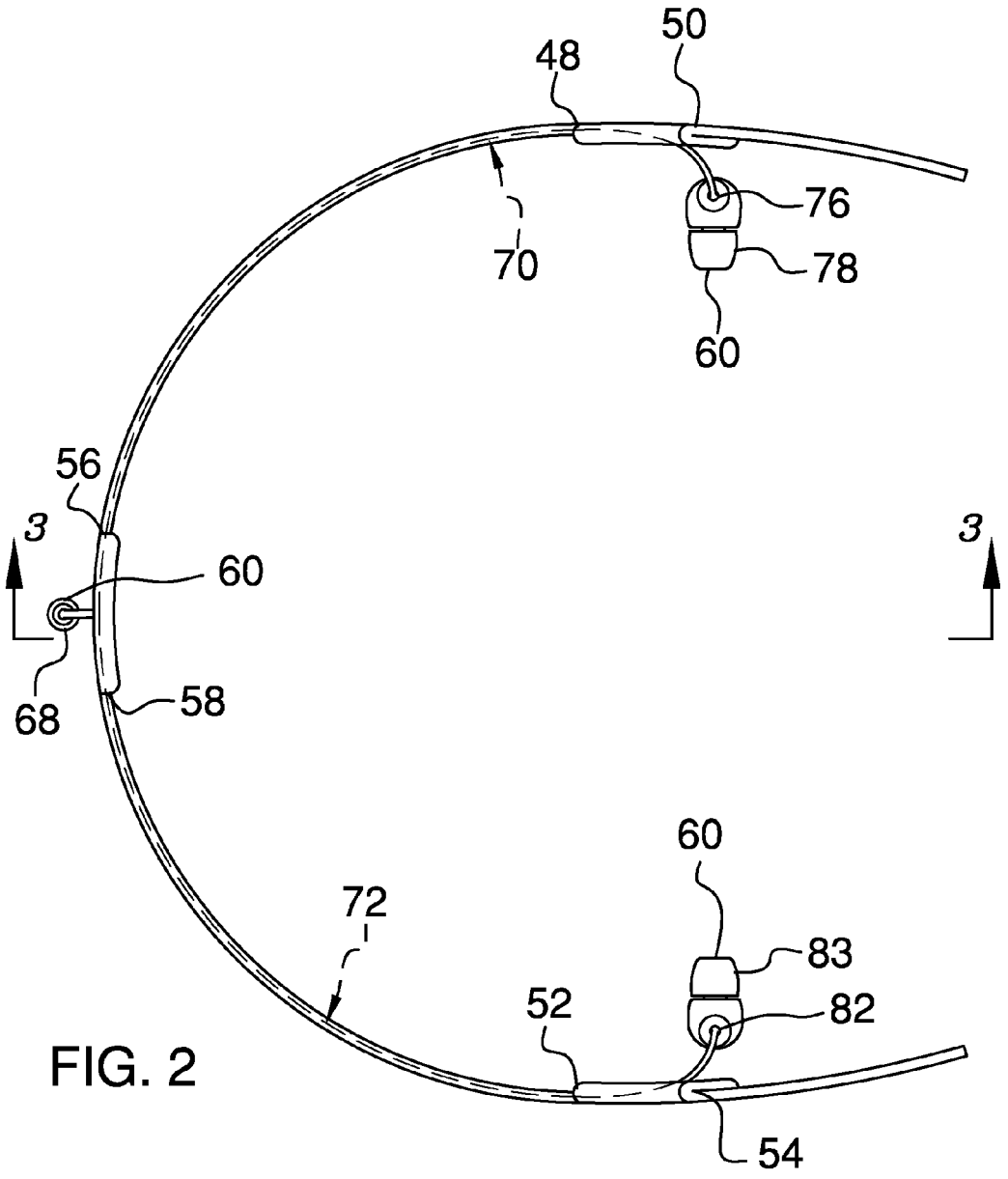
FIG. 2 is a top view of an embodiment of the disclosure.
Figure 3:
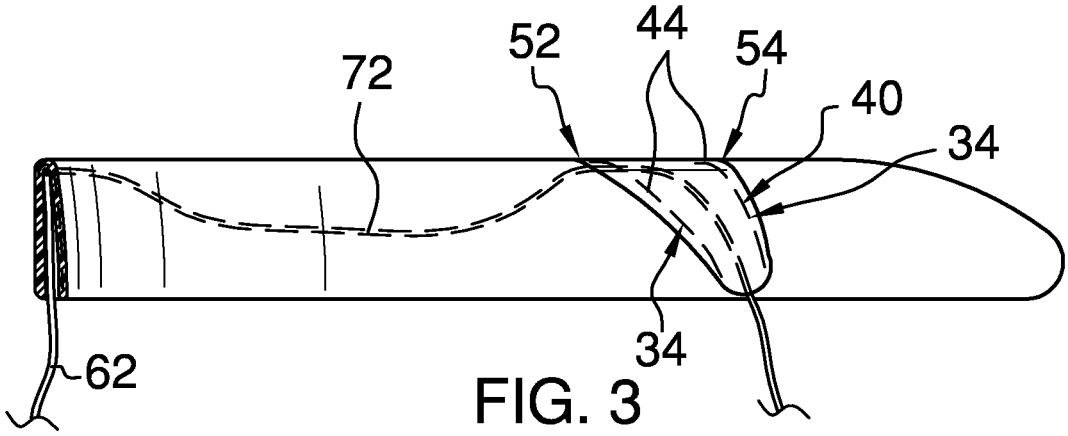
FIG. 3 is a cross-sectional view of an embodiment of the disclosure.
Figure 4:
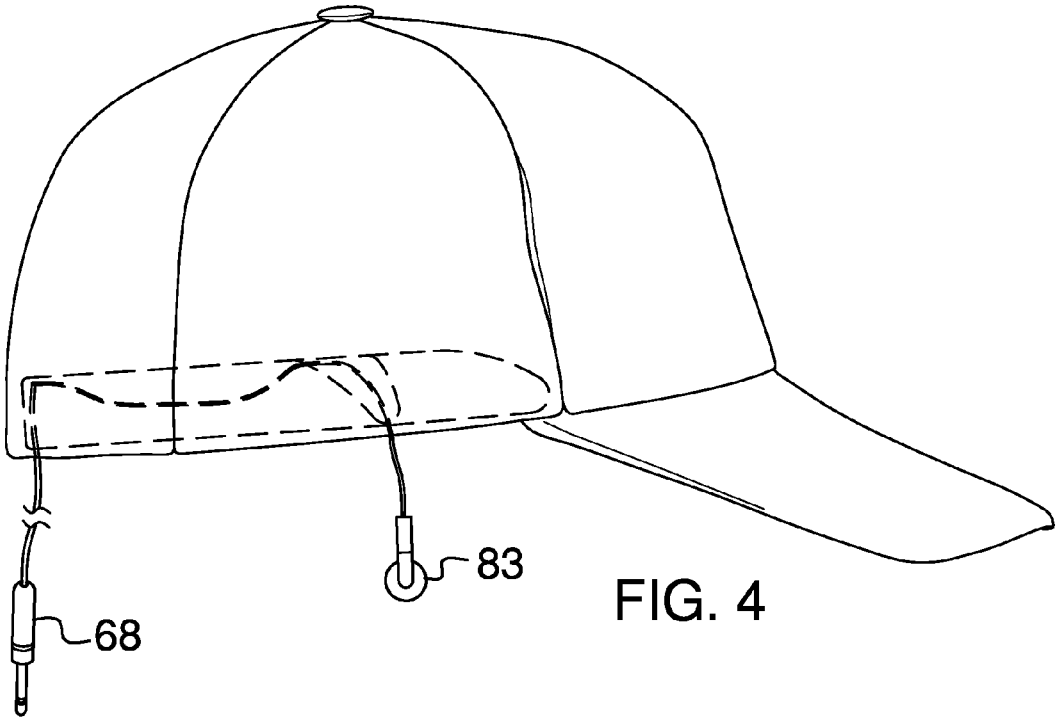
FIG. 4 is an in-use view of an embodiment of the disclosure.
Figure 5:
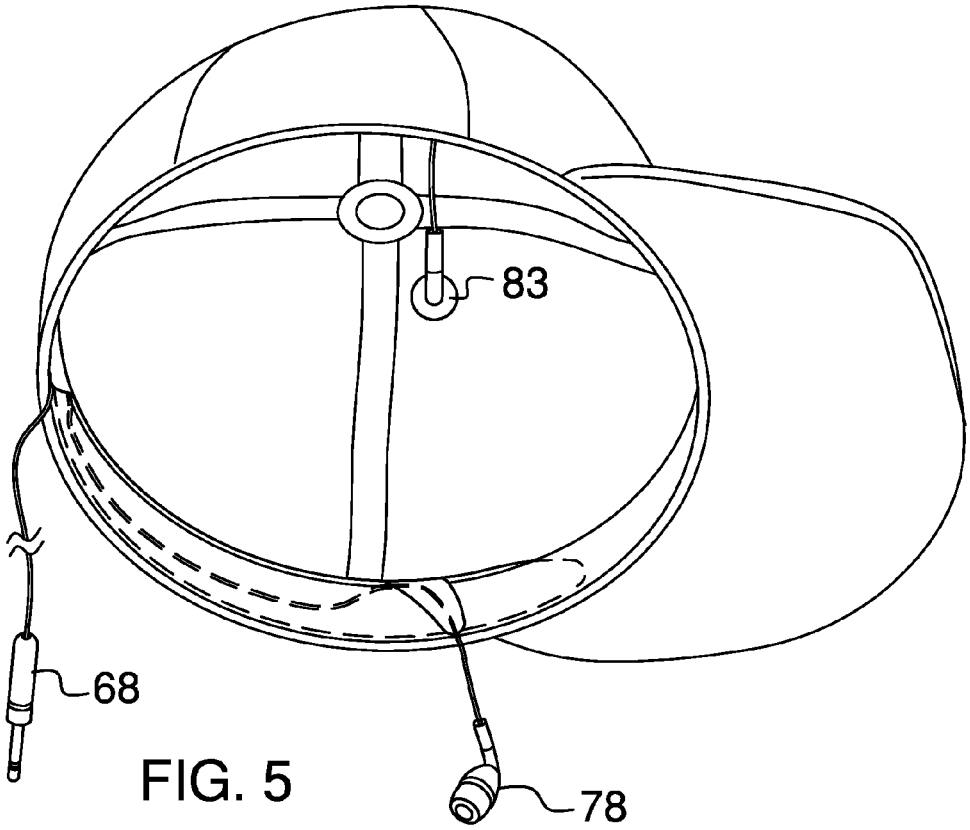
FIG. 5 is an in-use view of an embodiment of the disclosure.

With reference now to the drawings, and in particular to FIGS. 1 through 5 thereof, a new integrated headphone insert device embodying the principles and concepts of an embodiment of the disclosure and generally designated by the reference numeral 10 will be described.

As best illustrated in FIGS. 1 through 5, an integrated headphone insert device for listening to audio output while wearing a cap or hat 10 generally comprises a curved band 12 that is flexible. The curved band 12 has an interior surface 14, an exterior surface 16, a top edge 18, a bottom edge 20, a left front edge 22 and a right front edge 24 that extend between the top edge 18 and the bottom edge 20, and a solid internal body 26 defined by the top edge 18, the bottom edge 20, the left front edge 22 and the right front edge 24, the interior surface 14 and the exterior surface 16. The left front edge 22 and the right front edge 24 may be tapered. The device 10 comprises a left tab 28, a right tab 30 and a back tab 32 that are flexible. The left tab 28 is coupled to the top edge 18 proximate to the left front edge 22 and extends from the top edge 18 adjacent and parallel to the interior surface 14. The right tab 30 is coupled to the top edge 18 proximate to the right front edge 24 and extends from the top edge 18 adjacent and parallel to the interior surface 14. The back tab 32 is coupled to the top edge 18 equally distant to the left tab 28 and the right tab 30 and extends from the top edge 18 adjacent and parallel to the interior surface 14. The left tab 28, right tab 30 and back tab 32 may be extensions of the top edge 18.

The device 10 comprises a plurality of resilient wires 34; each of the resilient wires is a curved wire 36 that has a short section 38 and a long section 40. The short sections 38 are embedded in the solid internal body 26 of the curved band 12 and the long sections 40 are embedded in one of an associated one of the left tab 28, the right tab 30, and the back tab 32. In a preferred embodiment, the plurality of resilient wires 34 comprises two left wires 42, two right wires 44, and two back wires 46. The short sections 38 of the left wires 42 are embedded in the solid internal body 26 of the curved band 12 proximate to the left tab 28 and the long sections 40 of the left wires 42 are embedded in the left tab 28. One of the left wires 42 may be embedded in the solid internal body 26 and the left tab 28 proximate to a proximate junction 48 of the left tab 28 and the top edge 18, while the other of the left wires 42 may be embedded in the solid internal body 26 band the left tab 28 proximate to a distal junction 50 of the left tab 28 and the top edge 18. The short sections 38 of the right wires 44 are embedded in the solid internal body 26 of the curved band 12 proximate to the right tab 30 and the long sections 40 of the right wires 44 are embedded in the right tab 30. One of the right wires 44 may be embedded in the solid internal body 26 and the right tab 30 proximate to a proximate convergence 52 of the right tab 30 and the top edge 18, while the other of the right wires 44 may be embedded in the solid internal body 26 and the right tab 30 proximate to a distal junction 54 of the right tab 30 and the top edge 18. The short sections 38 of the back wires 46 are embedded in the solid internal body 26 of the curved band 12 proximate to the back tab 32 and the long sections 40 of the back wires 46 are embedded in the back tab 32. One of the back wires 44 may be embedded in the solid internal body 26 and the back tab 32 proximate to a left intersection 56 of the back tab 32 and the top edge 18, while the other of the back wires 44 may be embedded in the solid internal body 26 and the back tab 32 proximate to a right intersection 58 of the back tab 32 and the top edge 18.

The device 10 comprises an integrated headphone set 60 having a main cable 62 with a first end 64 and a split end 66. An input plug 68 is coupled to the first end 64 of the main cable 62, while the split end 66 is embedded in the back tab 32. The split end 66 may be embedded in the back tab 32 equally distant from the back wires 44. The split end 66 forms a left cable 70 and a right cable 72. The left cable 70 is embedded in the solid internal body 26 from the left intersection 56 of the back tab 32 and the top edge 18 to the proximate junction 48 of the left tab 28 and the top edge 18. The left cable 70 is embedded in the left tab 28 until exiting out the bottom 74 of the left tab 28. The left cable 70 may be embedded in the left tab 28 equally distant from the left wires 42. The left cable 70 has a terminus 76 that is coupled to a left ear bud 78. The right cable 72 is embedded in the solid internal body 26 from the right intersection 58 of the back tab 32 and the top edge 18 to the proximate convergence 52 of the right tab 30 and the top edge 18. The right cable 72 is embedded in the right tab 30 until exiting out the foot 80 of the right tab 30. The right cable 72 may be embedded in the right tab 30 equally distant from the right wires 44. The right cable 72 has an end 82 that is coupled to a right ear bud 83.

In use, the curved band 12 can be place inside of the lining of a cap or hat with the left tab, the right tab and the back tab engaging the lining to secure the curved band inside the cap or hat. With the cap or hat positioned on the head of the user, the left ear bud is proximate to the user's left ear and the right ear bud is proximate to the user's right ear, and the input jack extends from the back tab via the main cable to supply a direct or indirect connection to an audio source.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An integrated headphone insert device for listening to audio output while wearing a cap or hat, said device comprising:

a band, said band being curved and flexible, said band having an interior surface, an exterior surface, a top edge, a bottom edge, a left front edge and a right front edge extending between said top edge and said bottom edge, and a solid internal body defined by said top edge, said bottom edge, said left front edge and said right front edge, said interior surface and said exterior surface, a left tab, said left tab being flexible, said left tab being coupled to said top edge proximate to said left front edge, said left tab extending from said top edge adjacent and parallel to said interior surface, a right tab, said right tab being flexible, said right tab being coupled to said top edge proximate to said right front edge, said right tab extending from said top edge adjacent and parallel to said interior surface, a back tab, said back tab being flexible, said back tab being coupled to said top edge equally distant to said left tab and said right tab, said back tab extending from said top edge adjacent and parallel to said interior surface; and an integrated headphone set, said headphone set comprising a main cable, said main cable having a first end and a split end, an input plug, said input plug being coupled to said first end of said main cable, said split end being embedded in said back tab, said split end forming a left cable and a right cable, said left cable being embedded in said solid internal body from a left intersection of said back tab and said top edge to a proximate junction of said left tab and said top edge, said left cable being embedded in said left tab until exiting out the bottom of said left tab, said left cable having a terminus, said terminus being coupled to a left ear bud, said right cable being embedded in said solid internal body from a right intersection of said back tab and said top edge to a proximate convergence of said right tab and said top edge, said right cable being embedded in said right tab until exiting out the foot of said right tab, said right cable having an end, said end being coupled to a right ear bud.

2. The device of claim 1, further including said left front edge and said right front edge being tapered.

3. The device of claim 1, further including said left tab, said right tab and said back tab being extensions of said top edge.

4. The device of claim 1, further including a plurality of resilient wires, each of said plurality of resilient wires being curved and having a short section and a long section, said short sections being embedded in said solid internal body of said curved band, said long sections being embedded in one of an associated one of said left tab, said right tab, and said back tab.

5. The device of claim 4, further comprising:

said plurality of resilient wires comprising two left wires, two right wires, and two back wires;

said short sections of said left wires being embedded in said solid internal body of said curved band proximate to said left tab;

said long sections of said left wires being embedded in said left tab;

said short sections of said right wires being embedded in said solid internal body of said curved band proximate to said right tab;

said long sections of said right wires being embedded in said right tab;

said short sections of said back wires being embedded in said solid internal body of said curved band proximate to said back tab; and said long sections of said back wires being embedded in said back tab.

6. The device of claim 5, further comprising:

one of said left wires being embedded in said solid internal body and said left tab proximate to said proximate junction of said left tab and said top edge;

the other of said left wires being embedded in said solid internal body and said left tab proximate to a distal junction of said left tab and said top edge;

one of said right wires being embedded in said solid internal body and said right tab proximate to said proximate junction of said right tab and said top edge;

the other of said right wires being embedded in said solid internal body and said right tab proximate to a distal junction of said right tab and said top edge;

one of said back wires being embedded in said solid internal body and said back tab proximate to said left intersection of said back tab and said top edge; and the other of said back wires being embedded in said solid internal body and said back tab proximate to said right intersection of said back tab and said top edge.

7. The device of claim 6, further comprising:

said split end being embedded in said back tab equally distant from said back wires;

said left cable being embedded in said left tab equally distant from said left wires; and said right cable being embedded in said right tab equally distant from said right wires.

8. An integrated headphone insert device for listening to audio output while wearing a cap or hat, said device comprising:

a curved band, said band being flexible, said curved band having an interior surface, an exterior surface, a top edge, a bottom edge, a left front edge and a right front edge extending between said top edge and said bottom edge, said left front edge and said right front edge being tapered, and a solid internal body defined by said top edge, said bottom edge, said left front edge and said right front edge, said interior surface and said exterior surface;

a left tab, said left tab being flexible, said left tab being coupled to said top edge proximate to said left front edge, said left tab extending from said top edge adjacent and parallel to said interior surface, said left tab being an extension of said top edge;

a right tab, said right tab being flexible, said right tab being coupled to said top edge proximate to said right front edge, said right tab extending from said top edge adjacent and parallel to said interior surface, said right tab being an extension of said top edge;

a back tab, said back tab being flexible said back tab being coupled to said top edge equally distant to said left tab and said right tab, said back tab extending from said top edge adjacent and parallel to said interior surface, said back tab being an extension of said top edge;

a plurality of resilient wires, each of said plurality of resilient wires being curved and having a short section and a long section, said short sections being embedded in said solid internal body of said curved band, said long sections being embedded in one of an associated one of said left tab, said right tab, and said back tab, said plurality of resilient wires comprising two left wires, two right wires, and two back wires, said short sections of said left wires being embedded in said solid internal body of said curved band proximate to said left tab and said long sections of said left wires being embedded in said left tab, one of said left wires being embedded in said solid internal body and said left tab proximate to a proximate junction of said left tab and said top edge, the other of said left wires being embedded in said solid internal body and said left tab proximate to a distal junction of said left tab and said top edge, said short sections of said right wires being embedded in said solid internal body of said curved band proximate to said right tab and said long sections of said right wires being embedded in said right tab, one of said right wires being embedded in said solid internal body and said right tab proximate to a proximate convergence of said right tab and said top edge, the other of said right wires being embedded in said solid internal body and said right tab proximate to a distal junction of said right tab and said top edge, said short sections of said back wires being embedded in said solid internal body of said curved band proximate to said back tab and said long sections of said back wires being embedded in said back tab, one of said back wires being embedded in said solid internal body and said back tab proximate to a left intersection of said back tab and said top edge, the other of said back wires being embedded in said solid internal body and said back tab proximate to a right intersection of said back tab and said top edge;

an integrated headphone set, said headphone set comprising a main cable, said main cable having a first end and a split end, an input plug, said input plug being coupled to said first end of said main cable, said split end being embedded in said back tab, said split end being embedded in said back tab equally distant from said back wires, said split end forming a left cable and a right cable, said left cable being embedded in said solid internal body from said left intersection to said proximate junction, said left cable being embedded in said left tab until exiting out the bottom of said left tab, said left cable being embedded in said left tab equally distant from said left wires, said left cable having a terminus, said terminus being coupled to a left ear bud, said right cable being embedded in said solid internal body from said right intersection to said proximate convergence, said right cable being embedded in said right tab until exiting out the foot of said right tab, said right cable being embedded in said right tab equally distant from said right wires, said right cable having an end, said end being coupled to a right ear bud; and wherein said curved band can be place inside of the lining of a cap or hat with said left tab, said right tab and said back tab engaging the lining to secure said curved band inside the cap or hat, wherein said left ear bud is proximate to the user's left ear and said right ear bud is proximate to the user's right ear, and wherein said input jack extends from said back tab via said main cable for direct or indirect connection to an audio source.

* * * * *